US007975771B2

(12) United States Patent
Ford

(10) Patent No.: US 7,975,771 B2
(45) Date of Patent: Jul. 12, 2011

(54) METHOD FOR RUNNING CASING WHILE DRILLING SYSTEM

(75) Inventor: David L. Ford, Katy, TX (US)

(73) Assignee: Vetco Gray Inc., Houston, TX (US)

( * ) Notice: Subject to any disclaimer, the term of this patent is extended or adjusted under 35 U.S.C. 154(b) by 729 days.

(21) Appl. No.: 11/951,781

(22) Filed: Dec. 6, 2007

(65) Prior Publication Data

US 2008/0135289 A1 Jun. 12, 2008

Related U.S. Application Data

(60) Provisional application No. 60/873,049, filed on Dec. 6, 2006.

(51) Int. Cl.
*E21B 15/02* (2006.01)
*E21B 11/00* (2006.01)
*E21B 3/00* (2006.01)

(52) U.S. Cl. ..... 166/358; 166/348; 175/5; 175/7; 175/113; 175/171; 175/257

(58) Field of Classification Search ..... 166/348, 166/368, 358, 242.7; 175/5–10, 171, 257
See application file for complete search history.

(56) References Cited

U.S. PATENT DOCUMENTS

| | | | | |
|---|---|---|---|---|
| 2,641,444 | A * | 6/1953 | Moon | 166/381 |
| 3,015,360 | A * | 1/1962 | Stratton | 166/354 |
| 3,086,590 | A * | 4/1963 | Jackson, Jr. et al. | 166/348 |
| 3,123,160 | A * | 3/1964 | Kammerer | 175/82 |
| 3,125,171 | A * | 3/1964 | Stewart, III | 175/5 |
| 3,145,775 | A * | 8/1964 | Mccarty | 166/352 |
| 3,159,218 | A * | 12/1964 | Wilde | 166/352 |
| 3,191,696 | A * | 6/1965 | Pollard et al. | 175/7 |
| 3,215,201 | A * | 11/1965 | Lacy et al. | 166/352 |
| 3,219,117 | A * | 11/1965 | Johnstone et al. | 166/352 |
| 3,236,301 | A * | 2/1966 | Johnstone et al. | 166/338 |
| 3,259,198 | A * | 7/1966 | Montgomery et al. | 175/7 |
| 3,336,978 | A * | 8/1967 | Hynes | 166/285 |
| 3,468,558 | A * | 9/1969 | Ahlstone | 285/18 |
| 3,519,071 | A * | 7/1970 | Word, Jr. | 166/351 |
| 3,608,652 | A * | 9/1971 | Medders et al. | 175/7 |
| 3,700,048 | A * | 10/1972 | Desmoulins | 175/6 |
| 3,741,294 | A * | 6/1973 | Morrill | 166/367 |
| 3,901,331 | A * | 8/1975 | Djurovic | 175/171 |

(Continued)

FOREIGN PATENT DOCUMENTS

WO WO 2004/072434 A3 8/2004

*Primary Examiner* — Thomas A Beach
(74) *Attorney, Agent, or Firm* — Bracewell & Giuliani LLP

(57) ABSTRACT

At least a portion of a subsea well is drilled casing-while-drilling techniques. A landing shoulder is formed within an outer string of a casing. The outer string of casing is secured to an outer wellhead housing above the landing shoulder and lowered into the wellbore. A casing hanger is attached to an inner string of casing and lowered through the outer string of casing into the wellbore. A drill bit at the at the lower end of the inner string of casing is rotated to deepen the well. The string of inner casing moves downward as the well is being deepened until landing the casing hanger on the load shoulder. A tieback member is attached to an inner wellhead housing and lowered into sealing engagement with the casing hanger. The inner wellhead housing lands in the outer wellhead housing.

19 Claims, 3 Drawing Sheets

U.S. PATENT DOCUMENTS 4,093,030 A * 6/1978 Bonds ..... 166/382
4,133,396 A * 1/1979 Tschirky ..... 175/57
4,548,273 A * 10/1985 Leicht et al. ..... 166/348
4,759,413 A * 7/1988 Bailey et al. ..... 175/6
4,813,496 A * 3/1989 Rohweller et al. ..... 175/7
5,082,069 A * 1/1992 Seiler et al. ..... 175/5
5,184,686 A * 2/1993 Gonzalez ..... 175/5
5,392,852 A * 2/1995 Laurel et al. ..... 166/153
6,386,291 B1 * 5/2002 Short et al. ..... 166/368
6,412,574 B1 * 7/2002 Wardley et al. ..... 175/7
6,543,552 B1 * 4/2003 Metcalfe et al. ..... 175/57
6,854,533 B2 * 2/2005 Galloway et al. ..... 175/22
6,857,487 B2 * 2/2005 Galloway et al. ..... 175/171
6,899,186 B2 * 5/2005 Galloway et al. ..... 175/5
7,083,005 B2 * 8/2006 Galloway et al. ..... 175/5
7,108,080 B2 * 9/2006 Tessari et al. ..... 175/21
7,311,148 B2 * 12/2007 Giroux et al. ..... 166/285
7,334,650 B2 * 2/2008 Giroux et al. ..... 175/26
7,367,410 B2 * 5/2008 Sangesland ..... 175/7
7,784,552 B2 * 8/2010 Brouse ..... 166/382
2004/0112603 A1 6/2004 Galloway et al.
2004/0124010 A1 * 7/2004 Galloway et al. ..... 175/57
2005/0103525 A1 * 5/2005 Sangesland ..... 175/7
2006/0196695 A1 * 9/2006 Giroux et al. ..... 175/57

* cited by examiner

METHOD FOR RUNNING CASING WHILE DRILLING SYSTEM

CROSS-REFERENCE TO RELATED APPLICATION

This application claims priority to U.S. provisional application 60/873,049 filed Dec. 6, 2006.

FIELD OF THE INVENTION

This invention relates in general to drilling with portions of an offshore well with casing as the drill string rather than drill pipe.

BACKGROUND OF THE INVENTION

An offshore subsea well normally is drilled to a first depth, then an outer or low pressure wellhead housing with a string of conductor pipe or outer casing is installed. The operator then will normally drill the well to a second depth and install an inner string of casing within the conductor pipe. An inner or high pressure wellhead housing is secured to the upper end of the inner string of casing and landed in the low pressure wellhead housing. A drilling riser with a blowout preventer is attached to the high pressure wellhead housing. The operator then drills the well deeper through the drilling riser and runs one or more additional strings of inner casing.

Offshore well drilling is normally performed with a drill bit attached to drill pipe. After drilling each section to a desired depth, the operator runs and cements a string of casing in the well. After retrieving the drill pipe and before running the casing, the wellbore is prevented from collapsing by the mudcake on the borehole wall and the weight of the drilling mud in the borehole. In certain geographic zones, the open borehole tends to collapse easily because of they may be unconsolidated, and formation pressure causes water flow from the formation into the borehole.

One known technique for well drilling is called "casing-while-drilling". In that technique, the drill bit is secured to the lower end of a string of casing and lowered into the wellbore. The bit is rotated either by rotating the casing or by pumping drilling fluid to a mud motor attached to the casing. After the desired depth is reached, the casing is cemented. The drill bit may be an expendable type that remains cemented in the wellbore. Alternately, it might be retrieved through the casing before cementing. If a mud motor is employed, it normally would be retrieved along with the bit before cementing the well. Casing-while-drilling has a number of advantages. One of them would be to prevent the borehole in certain formations from collapsing prior to cementing.

The currently available equipment for casing-while-drilling is designed for use in land wells. A land well normally would not have a low pressure wellhead housing and a high pressure wellhead housing. One problem associated with using casing-while-drilling for drilling with the subsea outer string of casing is that the outer string of casing is typically smaller in inner diameter than the high pressure wellhead housing to which it is attached. Common dimensions are 18¾ inches internal diameter for the high pressure wellhead housing and 20 inches internal diameter for the first inner string of casing. A retrievable drill bit, either with or without a mud motor, for drilling the hole for the 20 inch casing would normally be large to pull through the 18¾ inch high pressure wellhead housing. Using casing-while-drilling to install the 20 inch casing might have benefits, but is not currently being done.

SUMMARY

In this invention, a landing shoulder is provided within an outer string of a casing, which is attached to an outer wellhead housing above the landing shoulder. A drill bit is attached to a lower end of an inner string of casing, and the inner string of casing is lowered through the outer string of casing into the wellbore. The operator then rotates the drill bit to deepen the well. The inner string of casing has a casing hanger on its upper end that lands on the landing shoulder when the drill bit has reached a selected depth. The drill bit is retrieved.

Then a tieback member is attached to an inner wellhead housing and lowered into sealing engagement with the casing hanger. The inner wellhead housing lands in the outer wellhead housing.

DETAILED DESCRIPTION OF THE INVENTION

Figure 1A:
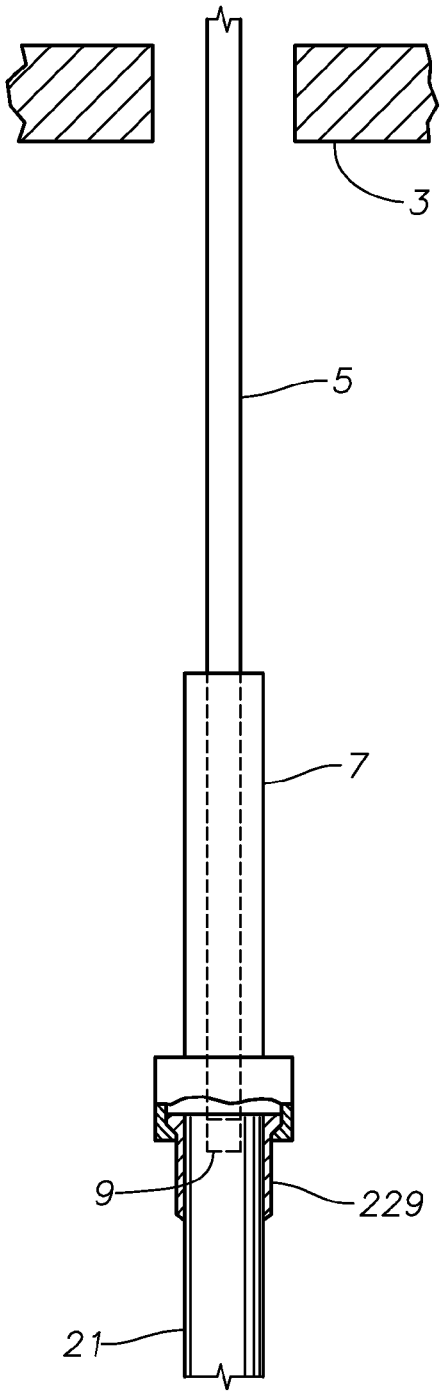
FIGS. 1A and 1B are a schematic view illustrating a subsea well in the process of being drilled with casing having a downhole drilling assembly on its lower end.
Figure 1B:
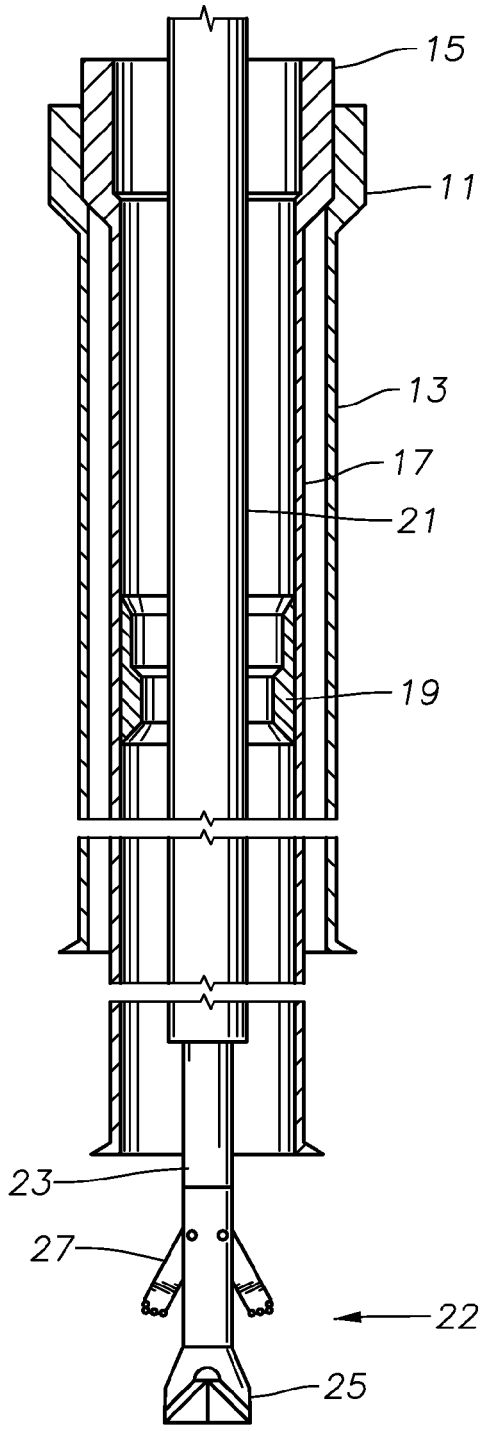

Referring to FIG. 1A, a floating drilling platform 3 is schematically illustrated. A string of drill pipe 5 is being lowered from drilling platform 3. A running tool 7 is attached to a lower end of drill pipe 5. Running tool 7 is secured to a casing hanger 29 of an inner string of casing 21, which is being lowered into a subsea well. In this example, drill pipe 5 has an engagement tool 9 on its lower end, subsequently explained.

Referring to FIG. 11B, the subsea well shown in this example has an outer wellhead housing 11 located at the sea floor and secured to an outer conductor string 13. Outer conductor string 13 extends into the well to a first depth and would normally be cemented in place. Outer wellhead housing 11 is a large tubular member that is thicker than conductor 13.

An intermediate wellhead housing 15 is shown installed within outer wellhead housing 11. Intermediate wellhead housing 15 has an outer casing string 17 secured to it. Outer casing string 17 extends to a greater depth than outer conductor string 13 and is cemented in place. Alternately, outer wellhead housing 11 and outer conductor string 13 could be omitted; in which case intermediate wellhead housing 15 would be the outer wellhead housing. A casing hanger landing sub 19 is secured into outer casing string 17 at a selected distance below intermediate wellhead housing 15. Casing hanger landing sub 15 has an upward facing shoulder on its inner diameter.

A downhole drilling assembly 22 is mounted in the lower end of inner casing 21. In the example shown, downhole drilling assembly 22 comprises a mud motor 23 that rotates a drill bit 25 and an under reamer 27 relative to casing 21. Mud motor 23 is secured by a latch (not shown) to the lower end of casing 21. Under reamer 27 is collapsible from a diameter larger than the outer diameter of casing 21 to a diameter smaller than the inner diameter of casing 21. Mud motor 23 operates in response to drilling fluid or mud being pumped down casing 21. The drilling mud returns up the annulus between inner casing 21 and outer casing 17, along with cuttings. The borehole for inner casing 21 may have been previously drilled below outer casing string 17 for part of the length of inner casing 21. Inner casing 21 is gradually lowered with drill pipe 5 (FIG. 1A) without rotation as downhole drilling assembly 22 performs the drilling operation. Alternately, casing 21 could be rotated with drill pipe 5 to rotate a downhole drilling assembly to perform the drilling operation.

Figure 2:
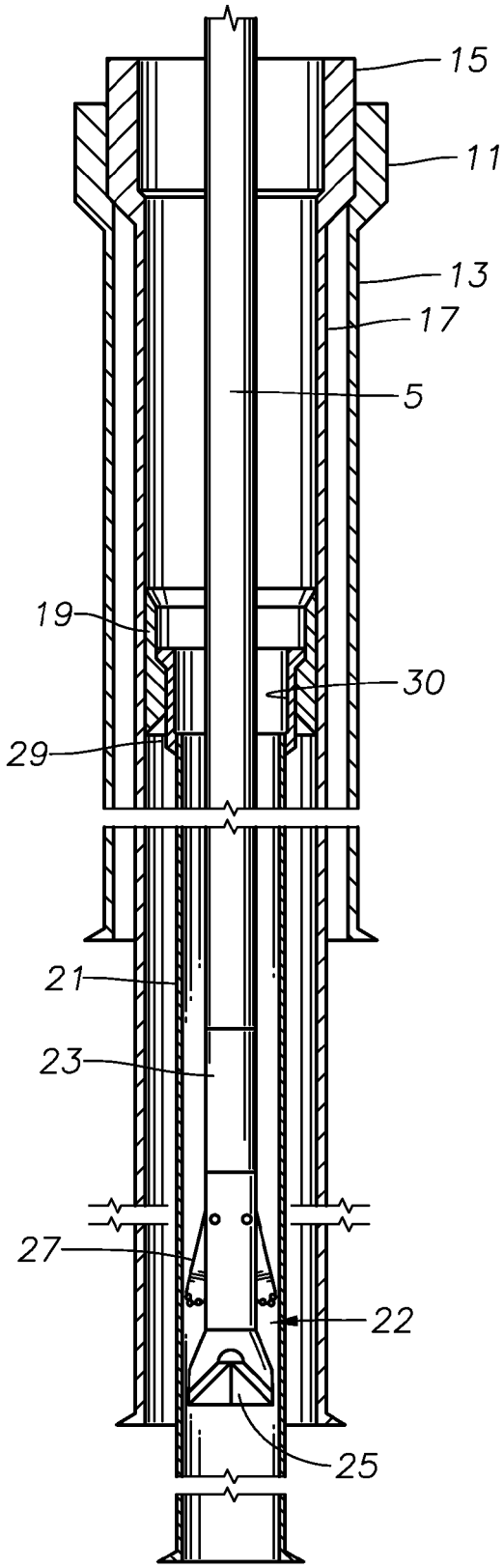
FIG. 2 is a schematic view of the well of FIG. 1, shown after the casing has been installed and showing the downhole drilling assembly being retrieved.

The operator continues drilling with downhole drilling assembly 22 and continues to lower casing 21 along with casing hanger 29 and running tool 7. Once the desired depth for inner casing 21 has been reached, the operator lands hanger 29 on casing hanger landing sub 19, as shown in FIG. 2. Running tool 7 is actuated to secure hanger 29 to landing sub 19 and optionally to actuate a seal between casing hanger 29 and casing hanger landing sub 19. Casing hanger 29 preferably has a receptacle 30 within its inner diameter.

After landing casing hanger 29, the operator retrieves downhole drilling assembly 22 and cements inner casing 21. Retrieval and cementing may be done in a number of ways. In one method, after setting casing hanger 29, drill pipe 5 is released from running tool 7 and lowered downward in inner casing 21 while running tool 7 remains attached to casing hanger 29. The operator engages engagement tool 9 on the end of drill pipe 5 with mud motor 23 and unlatches mud motor 23. The operator may then pull mud motor 23 and drill bit 25 upward until reaching running tool 7. Continued upward movement would then retrieve running tool 7 as well as motor 23 and drill bit 25. Under reamer 27 collapses while downhole drilling assembly 22 is being retrieved. The operator may cement casing 21 in place before retrieval of downhole drilling assembly 22 by pumping through drill pipe 5 after engagement tool 9 on drill pipe 5 has engaged mud motor 23. Alternately, cemented could be handled after retrieval of downhole drilling assembly 22. Further, downhole drilling assembly 22 could be retrieved in other manners, such as by a cable.

Figure 3:
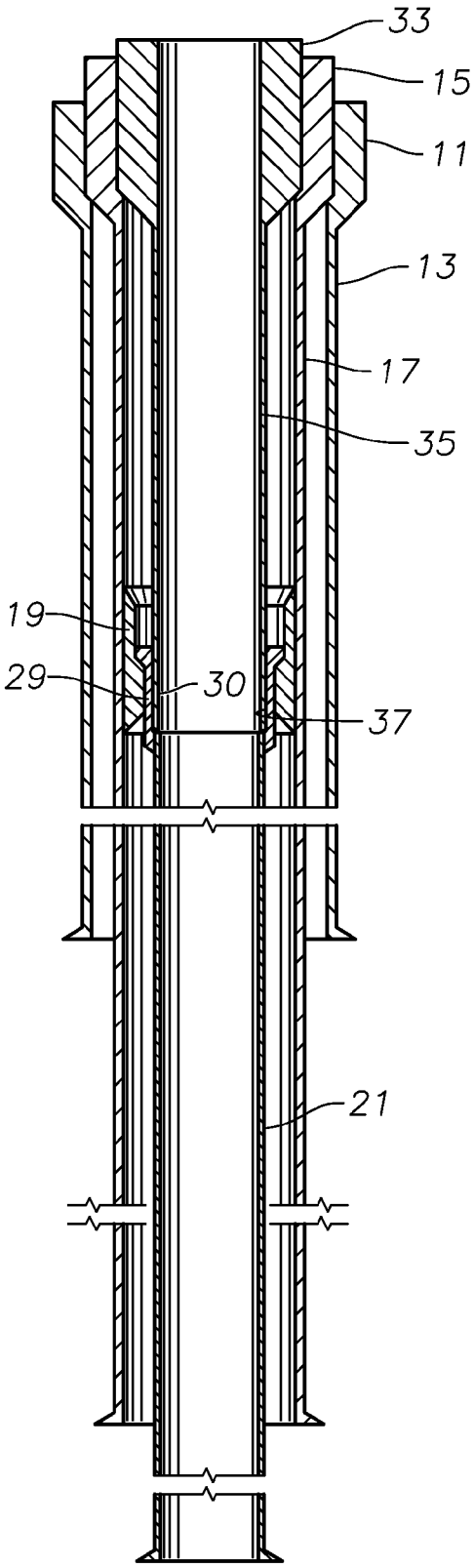
FIG. 3 is a schematic view of the subsea well as shown in FIG. 2, but showing a high pressure wellhead housing installed and a tieback string stabbed into the upper end of the casing hanger for the casing that was installed while drilling.
Figure 4:
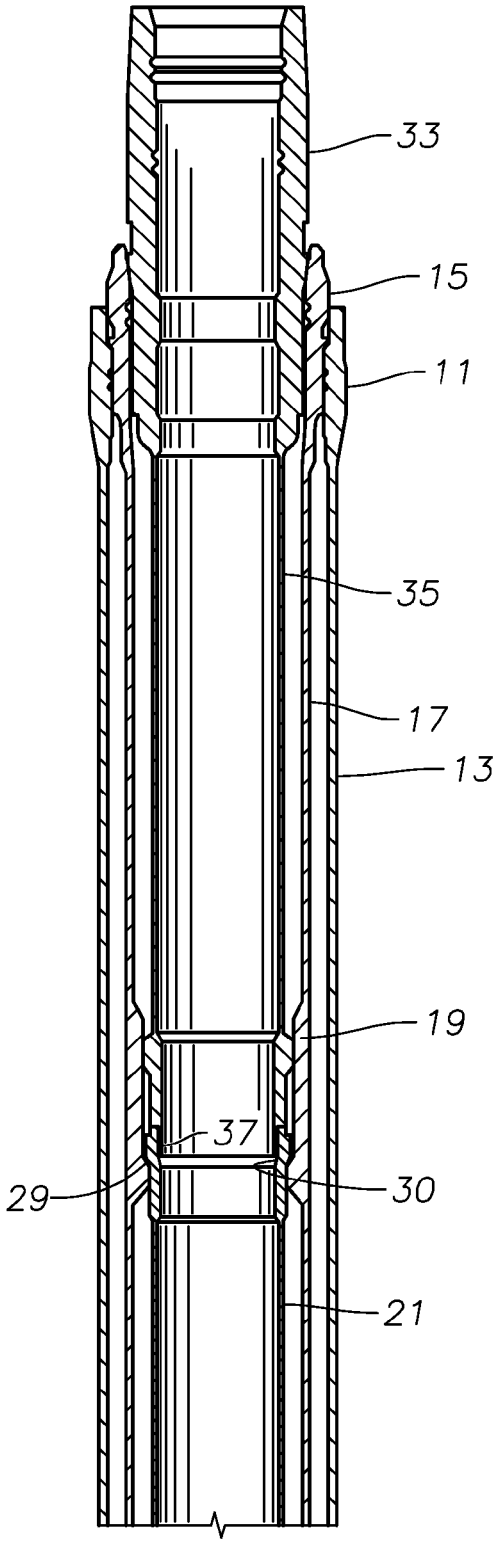
FIG. 4 is a more representative view of an upper portion the subsea well shown in FIG. 3.

Referring to FIG. 3, the operator then connects a tieback string 35 of casing to a high pressure or inner wellhead housing 33 and lowers the tieback string 35 through intermediate wellhead housing 15. Tieback string 35 preferably has the same inner diameter as casing 21. The lower end of tieback casing 35 slides into receptacle 30 of casing hanger 29. A seal 37 on the lower end of tieback casing 35 seals into receptacle 30. Inner wellhead housing 33 lands in intermediate wellhead housing 15. FIG. 4 is a more representative depiction of part of the schematic view of FIG. 3. Normally inner wellhead housing 33 has a smaller inner diameter than the inner diameter of inner casing 21. The outer diameter of downhole drilling assembly 22 may be too large to allow it to be retrieved through inner wellhead housing 33, thus it is retrieved before inner wellhead housing 33 is installed.

Subsequently, the operator may drill the well deeper and install another string of casing (not shown) within tieback string 35 and casing 21. For the additional depth, the operator may employ conventional drilling techniques using drill pipe, or utilize the operator may again utilize casing for drilling. After the well has been drilled to total depth, the operator would normally complete the well conventionally with production tubing.

In one example for using this method, a formation may exist around 900-1000 feet below the sea floor that causes water flow back into the wellbore and tends to cause collapsing of the wellbore. The operator would want the inner string of casing 21 to extend past that level, thus would want about 1100 feet of inner casing 21. If the sea is deep at that point, say 2000 feet or more, the operator could make up the assembly of 1100 feet of inner casing, along with downhole drilling assembly 22, and lower the assembly into the wellbore on drill pipe 5. The downhole drilling assembly 22 could be used to drill the entire depth from the lower end of conductor string 13 to 1100 feet.

If the water depth is less, such as only 400 feet, the entire 100 foot string could not be suspended on drill pipe, consequently, the operator may wish to pre-drill part of the borehole of inner casing string 21 conventionally with drill pipe. For example, if the washout zone occurs at 900 to 1000 feet, the operator could drill safely to 800 feet, then assemble and lower the 1100 feet string of inner casing 21 to 800 feet in the wellbore before beginning to drill with downhole drilling assembly 22.

Alternately, for shallow sea depths, the operator could drill the entire wellbore below outer casing 13 with inner casing 21 and downhole drilling assembly 22. Initially, the upper end of inner casing 21 would be at the drilling platform, and additional joints of inner casing would be added while drilling until the desired 1100 feet of casing was reached. At that point, the operator would attach casing hanger 29, running tool 7 and finish the drilling by lowering the assembly on drill pipe 5 until casing hanger 29 reached casing hanger landing sub 21.

Using casing-while-drilling at least through the washout zone reduces the risk of a collapsed wellbore.

While the invention has been shown in only one of its forms, it should be apparent to those skilled in the art that it is not so limited but is susceptible to various changes without departing from the scope of the invention.

The invention claimed is:

1. A method of drilling a subsea well, comprising:

(a) providing a landing shoulder within an outer string of a casing, securing an upper end of the outer string of casing to an outer wellhead housing above the landing shoulder, and lowering the outer string of casing into a wellbore;

(b) attaching a drill bit to a lower end of an inner string of casing, lowering the inner string of casing and the drill bit through the outer string of casing into the wellbore;

(c) rotating the inner string of casing and the drill bit to deepen the wellbore;

(d) attaching a casing hanger to an upper end of the inner string of casing and landing the casing hanger on the landing shoulder after the drill hit has reached a selected depth;

(e) cementing the inner string of casing in the wellbore after the casing hanger has landed on the landing shoulder; and (f) attaching a tieback member to an inner wellhead housing and lowering the tieback member into sealing engagement with the casing hanger and landing the inner wellhead housing in the outer wellhead housing.

2. The method according to claim 1, further comprising: after step (c) and before step (e) retrieving the drill hit from the inner string of casing while the inner string of casing remains in the wellbore.

3. The method according to claim 1, further comprising: after step (c) and before step (e), moving the drill bit upward through the inner string of casing to the drilling platform while the inner string of casing remains in the wellbore.

4. The method according to claim 1, wherein the inner wellhead housing has an inner diameter smaller than an outer diameter of the inner string of casing.

5. The method according to claim 1, wherein step (f) further comprises attaching a drilling riser to the inner wellhead housing.

6. The method according to claim 5, wherein step (f) further comprises lowering another drill bit through the drilling riser and the inner string of casing and drilling the well deeper.

7. The method according to claim 1, wherein:

the casing hanger is attached to the inner string of casing before performing step (c).

8. The method according to claim 1, wherein before step (c):

the casing hanger is attached to the inner string of casing;

a running tool is attached to the casing hanger;

an upper portion of a string of drill pipe extends upward from the running tool to the platform, and a lower portion of the string of drill pipe extends downward from the running tool through the inner string of casing to the drill bit; and after drilling to the selected depth in step (c), the operator sets the casing hanger with the running tool and retrieves the drill bit with the drill pipe while the inner string of casing remains in the wellbore.

9. The method according to claim 1, wherein:

an initial portion of the wellbore for the inner string of casing is drilled before lowering the inner string of casing into the wellbore in step (b).

10. A method of drilling a subsea well, comprising:

(a) forming a wellbore to a selected depth; then (b) providing a landing shoulder within an outer string of a casing, securing an upper end of the outer string of casing to an outer wellhead housing above the landing shoulder, lowering the outer string of casing into the wellbore until the outer wellhead housing is located at the sea floor, and cementing the outer string of casing in the wellbore;

(b) assembling an inner string of casing of a selected length, attaching a casing hanger to an upper end of the inner string of casing and lowering the inner string of casing through the outer string of casing into the wellbore;

(c) mounting a drill bit at the lower end of the inner string of casing, rotating the drill bit to deepen the well to a selected depth and landing the casing hanger on the landing shoulder; then (d) retrieving the drill bit from the inner string of casing while the inner string of casing remains in the wellbore and cementing the inner string of casing in the wellbore; then (e) attaching a tieback member to an inner wellhead housing and lowering the tieback member into scaling engagement with the casing hanger and landing the inner wellhead housing in the outer wellhead housing.

11. The method according to claim 10, further comprising attaching a drilling riser to the inner wellhead housing; and after step (e), lowering another drill bit through the drilling riser and the inner string of casing and drilling the wellbore to a deeper depth.

12. The method according to claim 10, wherein step (b) comprises lowering the inner string of casing on a string of drill pipe.

13. The method according to claim 12 wherein step (d) comprises retrieving the drill bit with the string of drill pipe.

14. The method according to claim 10, wherein the inner wellhead housing has an inner diameter smaller than an outer diameter of the inner string of casing.

15. The method according to claim 10, wherein:

step (d) occurs before step (e).

16. The method according to claim 10, wherein:

before step (b), the wellbore is drilled below the outer string of casing for a selected depth to receive a lower portion of the inner string of casing.

17. A method of drilling a subsea well, comprising:

(a) forming a wellbore to a selected depth; then (b) providing a landing shoulder within an outer string of casing, securing an upper end of the outer string of casing to an outer wellhead housing above the landing shoulder, lowering the outer string of casing into the wellbore until the outer wellhead housing is located at the sea floor, and cementing the outer string of casing in the wellbore;

(b) assembly an inner string of casing of a selected length, attaching a casing hanger to an upper end of the inner string of casing, a drill hit to a lower end of the inner string of casing, and a running tool to the casing hanger to make up an assembly, and attaching the running tool to a string of drill pipe and lowering the assembly on the string of drill pipe through the outer string of casing into the wellbore; then (c) rotating the inner string of casing and the drill bit to deepen the well to a selected depth and landing the casing hanger on the landing shoulder; then (d) retrieving the drill bit from the inner string of casing with the drill pipe while the inner string of casing remains in the wellbore, and cementing the inner string of casing in the wellbore; then (e) attaching a tieback member to an inner wellhead housing that has a smaller diameter bore than an outer diameter of the inner string of casing and lowering the tieback member into sealing engagement with the casing hanger and landing the inner wellhead housing in the outer wellhead housing.

18. The method according to claim 17, further comprising drilling the wellbore below the outer string of casing to a selected depth before running the assembly into the wellbore.

19. The method according to claim 17, wherein step (e) further comprises:

attaching a drilling riser to the inner wellhead housing; and lowering another drill bit through the drilling riser and the inner string of casing and drilling the well deeper.

* * * * *